US005377780A

United States Patent [19]

Dunaway

[11] Patent Number: 5,377,780

[45] Date of Patent: Jan. 3, 1995

[54] BRACKET ASSEMBLY FOR SAW HORSES

[76] Inventor: James T. Dunaway, 894 Wesleyn Dr., Fairfield, Ohio 45014

[21] Appl. No.: 134,686

[22] Filed: Oct. 12, 1993

[51] Int. Cl.[6] ..... E04G 1/00

[52] U.S. Cl. ..... 182/185; 248/188; 403/170; 403/217

[58] Field of Search ..... 182/181, 185; 269/37, 269/40; 248/188; 403/170, 174, 217, 260; 52/648.1, 650.2

[56] References Cited

U.S. PATENT DOCUMENTS

| | | | |
|---|---|---|---|
| 302,945 | 8/1884 | Sargent | 182/181 |
| 362,915 | 5/1887 | Zeigler | 182/185 X |
| 462,581 | 11/1891 | Peck | 182/185 X |
| 802,834 | 10/1905 | Upthegrove | 182/185 |
| 1,597,555 | 1/1925 | Tolmie | 182/224 |
| 2,559,696 | 7/1951 | Anderson | 182/185 |
| 2,736,614 | 2/1956 | Brewster, Jr. | 182/185 |
| 4,238,001 | 12/1980 | Alexander | 182/181 X |
| 4,890,952 | 1/1990 | Jones | 182/185 X |

*Primary Examiner*—Ramon O. Ramirez
*Attorney, Agent, or Firm*—Charles P. Wilson

[57] ABSTRACT

A bracket assembly for use in constructing a saw horse has a main bracket and an auxiliary bracket cooperatively engaged to readily form a rigid saw horse for use or readily permit the folding or break-apart of the saw horse for moving or storing. The main bracket has a generally inverted Y-shape with a vertical open-top channel to receive the auxiliary bracket and two inclined open-bottom channels to receive leg members of the saw horse. The auxiliary bracket has a H-shape with a vertical open-bottom channel to engage the vertical open-top channel of the main bracket and a vertical open-top channel to receive a cross-piece member of the saw horse. Attachment means allow a rigid though semi-permanent connection with the leg members and the cross-piece member and a rigid though removable connection between the main and auxiliary brackets.

12 Claims, 2 Drawing Sheets

BRACKET ASSEMBLY FOR SAW HORSES

This invention relates to a bracket assembly. More particularly, the invention relates to a bracket assembly useful for constructing a saw horse with fold or break-apart capability.

Saw horses are used by carpenters, painters and many other tradesmen. They represent an easy way to quickly erect a work surface to hold lumber during a cutting operation, create a table top work surface and a multitude of other functions. They are used on a daily basis. Saw horses are also used on occasion by the homeowner for the same purposes.

Saw horses have been used for many years. They all have the same basic design; namely, a cross-piece member and two inclined leg members at each end. The saw horses are almost always used in pairs. The only feature of saw horses which has materially changed over the years has been the manner in which the leg members are held to the cross-piece member. Various brackets have been developed. Some have been developed with rigidity of structure as the primary objective. Some have been developed with ease of set-up and break-apart as the primary objective. Still others have been developed where the primary objective appears to be a marginally acceptable product at the lowest cost of manufacture as possible. Examples of various brackets for saw horses are found in U.S. Pat. Nos. 302,945, 1,597,555, 2,559,696 and 2,736,614.

The tradesman who must use the saw horses on an almost daily basis is looking for a saw horse with a number of qualities. It must be capable of being rigidly assembled, free of wobble and concern over collapse. It must be capable of easy assembly and disassembly in that the saw horse may be moved to different locations and occasionally stored during the course of a single work day. It must also be affordable.

In accord with a long felt need experienced by many people over many years, there has now been developed a bracket assembly for a saw horse which fills all the needed requisites. The bracket assembly of the invention is durable, capable of forming a sturdy saw horse which is easy to assemble and disassemble. Additionally, the bracket assembly is capable of mass production to produce a product of uniform quality and reasonable cost.

SUMMARY OF THE INVENTION

A bracket assembly comprises a main bracket and an auxiliary bracket which are constructed for attachment to one another and for attachment to leg members and a cross-piece member to form a fully assembled saw horse. The main bracket removably holds the auxiliary bracket and semi-permanently holds the leg members of the saw horse. It has a generally inverted Y-shape with an open-top channel to receive the auxiliary bracket and two downwardly inclined open-bottom channels to receive two leg members of the saw horse. The auxiliary bracket has a H-shape with a vertical open-bottom channel to fit into the vertical open-top channel of the main bracket and a vertical open-top channel to receive the cross-piece member of the saw horse. The bracket assembly allows the saw horse to be readily assembled into a sturdy structure and readily folded or broken-apart for moving/storage purposes.

DETAILED DESCRIPTION OF THE INVENTION

The bracket assembly of the invention is described with particular reference to its use in constructing a saw horse for conventional use by both the tradesman and the homeowner. It should be understood the bracket assembly is particularly adapted for use with saw horses having 2×4 wood leg members and cross-piece members. It is adaptable for use with other sized leg and cross-piece members and materials other than wood, e.g. molded plastic.

Figure 1:
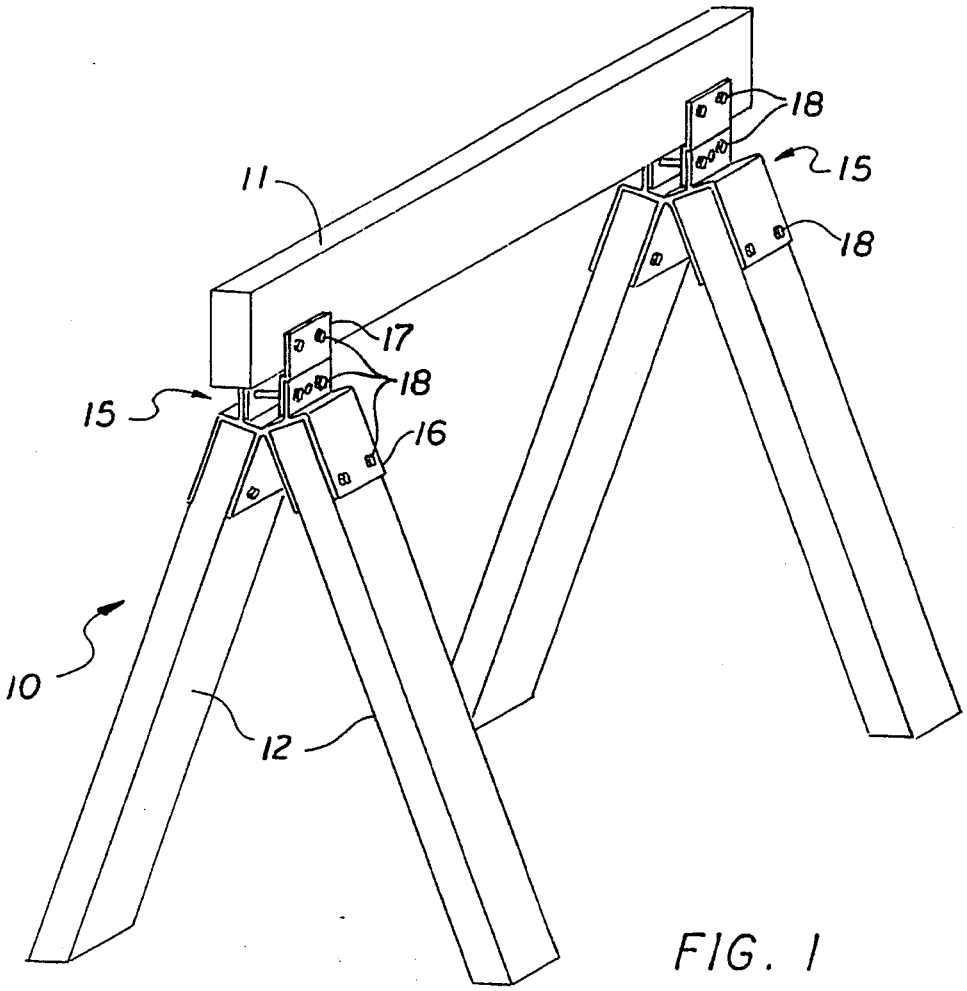
FIG. 1 is a perspective view of a saw horse with bracket assemblies of the invention in use.

With reference to FIG. 1, there is shown a saw horse 10 comprised of a cross-piece member 11, four leg members 12 and two bracket assemblies 15. A cross brace (not shown) can be attached to each set of leg members in a mid-portion to hold the leg members together to form an even more rigid saw horse, though is not necessary. Each bracket assembly comprises a main bracket 16 and an auxiliary bracket 17 with attachment means 18. The main bracket 16 and the auxiliary bracket 17 are cooperatively engaged to form a rigid connection, a foldable connection, or a break-apart connection as desired.

Figure 2:
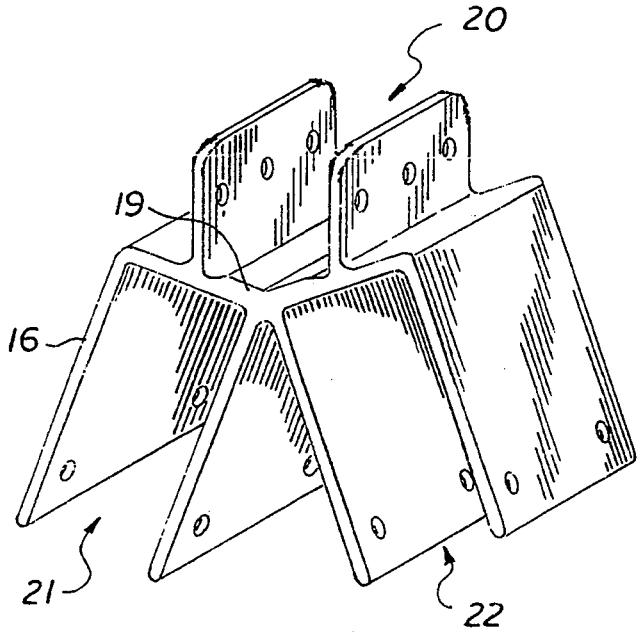
FIG. 2 is a perspective view of a main bracket forming a part of one of the bracket assemblies shown in FIG. 1.

As best seen in FIG. 2, the main bracket 16 has a generally inverted Y-shape. It has a central rib body 19 and extending therefrom a vertical open-top channel 20, a first inclined open-bottom channel 21 and a second inclined open-bottom channel 22. The angle of incline for the open-bottom channels generally ranges from about thirty degrees to about sixty-degrees from the vertical for optimum stability. The channels have parallel sidewalls which extend outwardly and downwardly from the central rib body 19. The width of the channels are dimensioned to receive the auxiliary bracket and the saw horse leg members, i.e. their width approximately equals respectively the width of the open-bottom channel of the auxiliary bracket and the depths of the leg members. The sidewalls of the vertical open-top channel have at least one hole, preferably all have two holes for the reasons discussed below. Three holes are shown for optimum versatility. At least the outer sidewall of each of the inclined open-bottom channels has at least one hole. An aligned hole in the other sidewall of the channel is preferably added by the user when the leg members are added.

Figure 3:
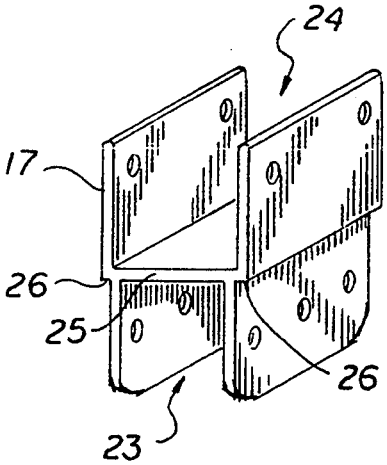
FIG. 3 is a perspective view of an auxiliary bracket forming another part of one of the bracket assemblies shown in FIG. 1.

The auxiliary bracket 17 has a H-shape as most evident in FIG. 3. It comprises an open-bottom channel 23 and an open-top channel 24 with a common cross wall 25. The channels are formed from vertical parallel sidewalls. The sidewalls of the open-bottom channel 23 are each inwardly offset from the sidewalls of the open-top channel 24 to create shoulders 26 on each side. When used with the main bracket 16, the open-bottom channel 23 fits into the open-top channel 20 of the main bracket and contact is made in the shoulders 26 to give a steady positioning, substantially perfect in hole alignment. Each of the sidewalls of the open-bottom channel of the auxiliary bracket 17 has at least one hole to receive attachment means. Preferably, each sidewall has two holes as discussed below. Three holes are provided in the open-bottom channel for alignment with the sidewalls of the channel 20 of the main bracket. At least one hole in at least one of the sidewalls of the open-top channel is also provided as a starter hole. The user preferably drills through the cross-piece member and the other sidewall to create two aligned holes for the attachment means.

The leg members of the saw horse are received by the inclined first and second open-bottom channels 21 and 22 of the main bracket 16. The attachment means used in the sidewall holes are bolts and nuts for a rigid, though semi-permanent attachment. Preferably, two holes are found in each sidewall for a more steady attachment to the saw horse leg members.

Holes in the sidewalls of the open-top channel 20 of the main bracket 16 are in alignment with holes in the sidewalls of the open-bottom channel 23 of the auxiliary bracket. One hole in all the sidewalls is the minimum needed to receive an attachment means, such as a clevis pin or a bolt and nut. Two holes in each of these sidewalls is preferred. With two holes in each of the sidewalls, the assembled saw horse has the capability of being folded together or broken apart dependent normally only on considerations such as storage space and transportability. Removal of one attachment means allows the set of leg members to pivot about the remaining attachment means for a folded condition. For this purpose, the corners of the sidewalls of the open-top channel of the main bracket and the corners of the sidewalls of the open-bottom channel of the auxiliary bracket are rounded so as not to hinder the pivot action. Removal of both attachment means allows the leg and cross-piece members to be broken apart completely. Attachment means such as clevis pins and bolts and nuts are used for this connection.

At least one hole and preferably two holes are used in the open-top channel of the auxiliary bracket to receive the attachment means to hold the cross-piece member. This bracket is intended to remain with the cross-piece member. Attachment means such as bolts and nuts or clevis pins are used.

The saw horse 10 of FIG. 1 is readily assembled using the bracket assemblies 15. The leg members of the saw horses are inserted into the inclined open-bottom channels of the main bracket. Appropriate attachment means are used to hold the leg members to the main bracket. The auxiliary bracket is positioned on an edge of the cross-piece member near an end and, here also, the attachment means used is dependent on the desired degree of permanency. The main bracket and auxiliary bracket are brought together and attached.

A saw horse which is assembled and intended for permanent use such as in the home workshop will often use the bolts and nuts for a rigid attachment of all the component pieces. A saw horse which will be constantly folded or broken-apart such as more prevalent in the building industry will more likely be assembled with bolts and nuts for the saw horse members and with clevis pins where the two brackets are attached together. The clevis pin is more readily removed and reinserted through the holes.

Figure 4:
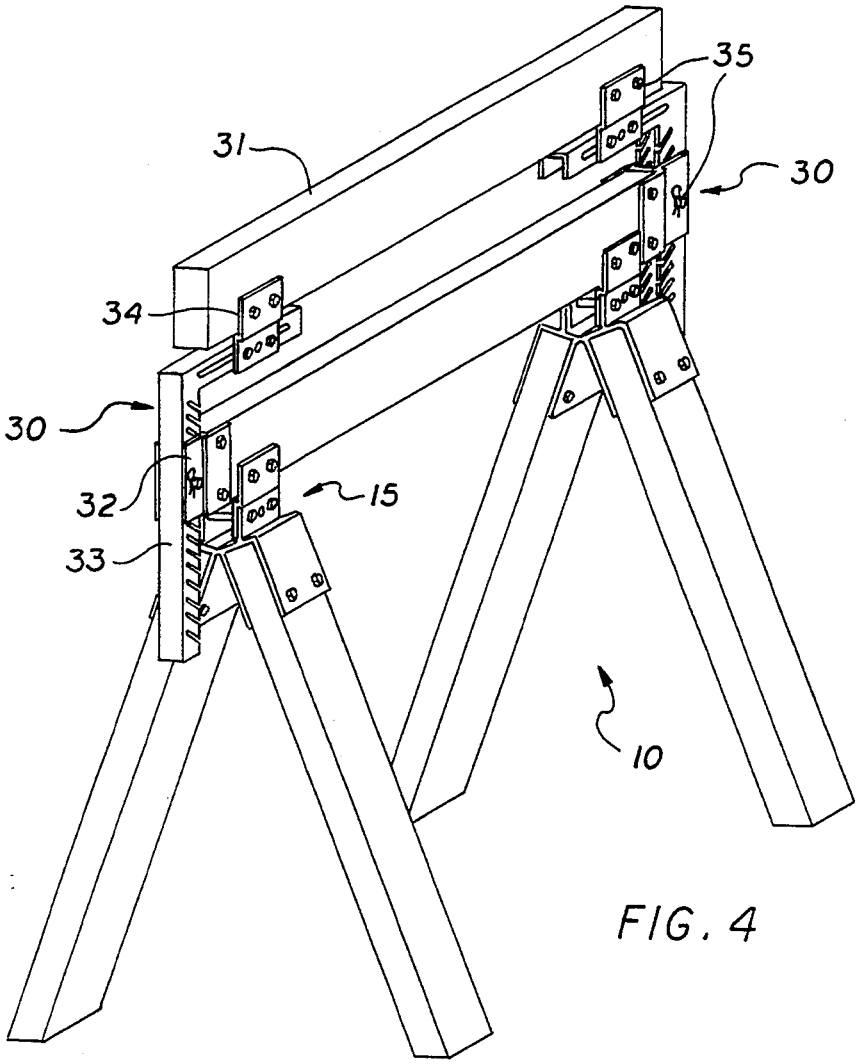
FIG. 4 is a perspective view of another saw horse having bracket assemblies of the invention and optional height adjusting bracket assemblies for an upper cross-piece member.
Figure 5:
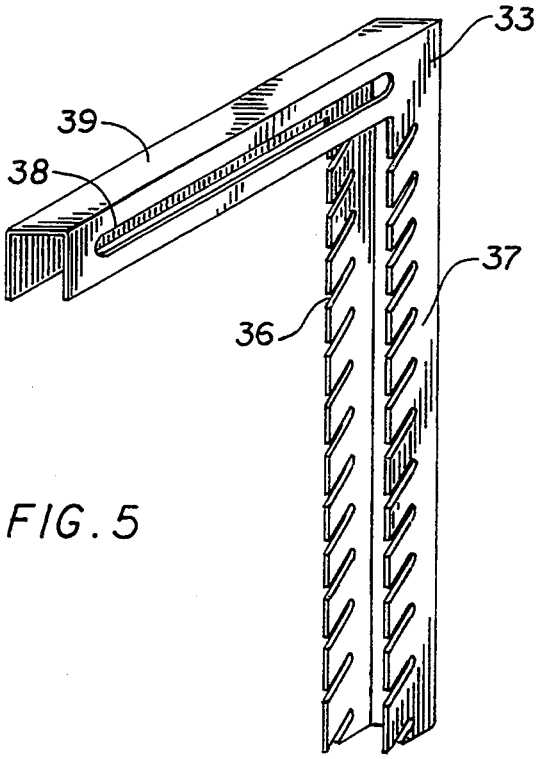
FIG. 5 is a perspective view of a L-shaped member used with an auxiliary bracket to adjust the height of the upper cross-piece member of the saw horse of FIG. 4.

FIGS. 4 and 5 illustrate an optional feature of the invention. Any saw horse has a height determined by the length of its leg members. To elevate the saw horse, it is necessary to change its leg members or, possibly prop the leg members up on blocks or some other usually portable object. In accord with the embodiment of the invention described with reference to FIGS. 4 and 5, the saw horse 10 is made higher by height adjusting bracket assemblies 30 and an upper cross-piece member 31. Each assembly 30 comprises a first auxiliary bracket 32, a L-shaped bracket 33 and a second auxiliary bracket 34 with attachment means 35.

The first auxiliary brackets 32 and the second auxiliary brackets 34 are identical in structure to the aforedescribed auxiliary bracket 17 used with the main bracket 16. The brackets 32 are each attached to an end of the cross-piece member 11 such that their free channels are open-sided. The L-shape bracket 33 has upwardly inclined open slots 36 in a vertical leg 37 to receive an attachment means 35 extending through the first auxiliary bracket 32. It also has a closed slot 38 in a horizontal leg 39 to receive an attachment means used with the second auxiliary bracket 34 and the upper cross-piece member 31. The upper cross-piece member 31 has the two auxiliary brackets 34 positioned on its underside near its two ends. The attachment means passing through the sidewalls of the open-bottom channel of the bracket 34 also passes through the closed slot 38 in the L-shape member's horizontal leg 39.

As should be evident, the height of the upper cross-piece member 31 is adjusted by first removing attachment means in each of the first auxiliary brackets 32. The second cross-piece member 31 is moved to a desired height and finally the attachment means are repositioned in the auxiliary brackets 32.

The auxiliary brackets used with the main bracket and in the optional height adjusting bracket assembly described above all preferably have the same configuration and are interchangeable. This feature adds to the versatility of the bracket assemblies of the invention without a significant cost increase.

While the invention has been described in detail, it should be understood various modifications can be made to the bracket assembly described. All such modifications and changes of an obvious nature are considered within the scope of the appended claims.

I claim:

1. A bracket assembly for use on a saw horse comprised of a cross-piece member and leg members to impart rigidity to said saw horse during use with folding or break-apart capability during non-use, said bracket assembly comprising:

(a) a main bracket to hold an auxiliary bracket and two leg members of the saw horse, said main bracket having an inverted Y-shape formed of a central rib body with a vertical open-top channel with two parallel sidewalls extending upwardly therefrom, a first inclined open-bottom channel with two parallel sidewalls extending outwardly and downwardly therefrom, a second inclined open-bottom channel with two parallel sidewalls extending outwardly and downwardly therefrom, wherein each of the sidewalls of the vertical open-top channel has at least one aligned hole to receive an attachment means so as to rigidly hold the auxiliary bracket and wherein at least one of each of the sidewalls of the first and second inclined open-bottom channels has at least one hole to receive an attachment means so as to rigidly hold a leg member of the saw horse; and (b) an auxiliary bracket removably attached to the main bracket and to permanently hold the cross-piece member of the saw horse, said auxiliary bracket having a H-shape formed of a body with a vertical open-bottom channel having two parallel sidewalls extending downwardly therefrom and a vertical open-top channel having two parallel sidewalls extending upwardly therefrom, wherein the sidewalls of the open-bottom channel have holes in alignment with the holes in the sidewalls of vertical open-top channel of the main bracket to receive attachment means and form the rigid attachment with the knock-down capability.

2. The bracket assembly of claim 1 wherein at least one of the sidewalls of the open-top channel of the auxiliary bracket has at least one hole to receive an attachment means to form a semi-permanent rigid attachment to the cross-piece member of the saw horse.

3. The bracket assembly of claim 1 wherein each of the sidewalls of the vertical open-top channel of the main bracket has two holes and the attachment means are clevis pins.

4. The bracket assembly of claim 3 wherein the inclined open-bottom channels of the main bracket have a width approximately equal to the depth of the leg members of the saw horse.

5. The bracket assembly of claim 4 wherein the open-bottom channel of the auxiliary bracket is dimensioned to snugly fit into the vertical open-top channel of the main bracket.

6. The bracket assembly of claim 5 wherein the sidewalls of the open-bottom channel of the auxiliary bracket are inwardly offset from the sidewalls of the open-top channel of the auxiliary bracket to form shoulders at the offset.

7. A saw horse for use by tradesmen and homeowners which has the capability of being rigidly connected, yet also readily foldable and broken-apart for ease of moving and storage, said saw horse comprising:

(a) a cross-piece member;

(b) four leg members; and (c) two bracket assemblies, each said bracket assembly having (i) a main bracket to hold an auxiliary bracket and attached to two leg members of the saw horse, said main bracket having an inverted Y-shape formed of a central rib body with a vertical open-top channel with two parallel sidewalls extending upwardly therefrom, a first inclined open-bottom channel with two parallel sidewalls extending outwardly and downwardly therefrom, a second inclined open-bottom channel with two parallel sidewalls extending outwardly and downwardly therefrom, wherein each of the sidewalls of the vertical open-top channel has at least one aligned hole to receive an attachment means so as to rigidly hold the auxiliary bracket and wherein each of the sidewalls of the first and second inclined open-bottom channels has at least one aligned hole to receive an attachment means so as to rigidly hold a leg member of the saw horse and (ii) an auxiliary bracket removably attached to the main bracket and holding the cross-piece member of the saw horse, said auxiliary bracket having a H-shape formed of a body with a vertical open-bottom channel having two parallel sidewalls extending downwardly therefrom and a vertical open-top channel having two parallel sidewalls extending upwardly therefrom, wherein the sidewalls of the open-bottom channel have holes in alignment with the holes in the sidewalls of vertical open-top channel of the main bracket to receive attachment means and form the rigid attachment with the knock-down capability.

8. The saw horse of claim 7 wherein the sidewalls of the open-top channel of the auxiliary bracket have at least one aligned hole to receive an attachment means to form a semi-permanent rigid attachment to the cross-piece member of the saw horse.

9. The saw horse of claim 7 wherein each of the sidewalls of the vertical open-top channel of the main bracket has two holes and the attachment means are clevis pins.

10. The saw horse of claim 9 wherein the inclined open-bottom channels of the main bracket have a width approximately equal to the depth of the leg members of the saw horse.

11. The saw horse of claim 10 wherein the open-bottom channel of the auxiliary bracket is dimensioned to snugly fit into the vertical open-top channel of the main bracket.

12. The saw horse of claim 7 further having height adjusting bracket assemblies and an upper cross-piece member wherein each of the height adjusting bracket assemblies comprises a second auxiliary bracket mounted on an end of the cross-piece member such that its channels are open-sided, a L-shaped bracket member having a vertical leg with a set of upwardly inclined open slots therein and a horizontal leg with a closed slot therein, and a third auxiliary bracket, wherein removable attachment means hold the second auxiliary bracket in the open slots of the vertical leg of the L-shaped bracket and attachment means hold the third auxiliary bracket in the closed slot of the horizontal leg of the L-shaped bracket and further wherein the upper cross-piece member is attached to the third auxiliary bracket.

* * * * *